US006049321A

United States Patent [19]

Sasaki

[11] Patent Number: 6,049,321

[45] Date of Patent: Apr. 11, 2000

[54] LIQUID CRYSTAL DISPLAY

[75] Inventor: Minoru Sasaki, Tokyo, Japan

[73] Assignee: Kabushiki Kaisha Toshiba, Kawasaki, Japan

[21] Appl. No.: 08/938,333

[22] Filed: Sep. 25, 1997

[30] Foreign Application Priority Data

Sep. 25, 1996 [JP] Japan ..... 8-253547
Jul. 11, 1997 [JP] Japan ..... 9-186151

[51] Int. Cl.[7] ..... G09G 3/36

[52] U.S. Cl. ..... 345/99; 345/98; 345/100; 345/96

[58] Field of Search ..... 345/99, 98, 100, 345/209, 92, 96, 205, 206, 94, 88

[56] References Cited

U.S. PATENT DOCUMENTS 5,602,561 2/1997 Kawaguchi et al. ..... 345/99
5,748,165 5/1998 Kubota et al. ..... 345/96

*Primary Examiner*—Richard A. Hjerpe
*Assistant Examiner*—Francis Nguyen
*Attorney, Agent, or Firm*—Pillsbury Madison & Sutro LLP

[57] ABSTRACT

A liquid crystal display includes a matrix array of liquid crystal pixels, data lines formed along columns of the pixels, TFTs assigned to the pixels for causing the data lines to be electrically connected to the pixels of a selected row, and a data line driver which drives the data lines and has a first video bus for transmitting analog pixel signals of the positive polarity for the pixels of one of odd and even columns in a selected row, a second video bus for transmitting analog pixel signals of the negative polarity for the pixels of the other one of the odd and even columns in the selected row, sample-hold units each assigned to adjacent two of the data lines to simultaneously sample-hold the pixel signals on the first and second video buses, and a shift register circuit for enabling the operations of the sample-hold units sequentially. Particularly, each sample-hold unit has a first switch circuit for causing the first and second video buses to be connected to one of the adjacent two data lines and the other one of the adjacent two data lines, and a second switch circuit for causing the first and second video buses to be connected to the other one of the adjacent two data lines and the one of the adjacent two data lines, and the shift register circuit has a logic circuit for periodically switching between the first and second switch circuits of each sample-hold unit.

17 Claims, 9 Drawing Sheets

LIQUID CRYSTAL DISPLAY

BACKGROUND OF THE INVENTION

The present invention relates to a flat-panel display used as an image monitor for a computer and a television receiver and particularly to a liquid crystal display driven by a signal voltage whose polarity is periodically reversed.

In recent years, liquid crystal displays have been widely used in views of merits of thickness, light weight, and low power consumption. The liquid crystal display has a structure in which a liquid crystal layer is held between an array substrate and a counter substrate. Each of the array substrate and the counter substrate, for example, has a light transmitting and insulating property, and the liquid crystal layer is made of liquid crystal composition filled into a gap between the array substrate and the counter substrate. The array substrate comprises a matrix array of pixel electrodes, a plurality of scanning lines formed along columns of the pixel electrodes, a plurality of signal lines formed along rows of the pixel electrode, and a first alignment film covering the entire matrix array of pixel electrodes. The scanning lines serve to select the corresponding rows of the pixel electrodes, and the signal lines serve to apply pixel electrode signal voltages to the pixel electrodes of the selected row. The counter substrate has a counter electrode facing the matrix array of pixel electrodes, and a second alignment film covering the entire counter electrode. The first and second alignment films are provided for causing liquid crystal molecules of the liquid crystal layer to be set in a twisted nematic (TN) alignment when no potential difference exists between the pixel electrode and the counter electrode. When light is incident to the liquid crystal layer from one substrate side through a polarizing plate, light rotates along the twist of the liquid crystal molecules aligned in the thickness direction of the liquid crystal layer, so as to be guided to the other substrate, and selectively transmitted through a polarizing plate. If a potential difference is provided between the pixel electrode and the counter electrode, the molecules are tilted up by an angle, which is proportional to the potential difference, from the plane parallel to the substrate surface where an image is displayed. As a result, light transmittance is changed.

In an active matrix liquid crystal display, a plurality of thin film transistors (TFT) are respectively formed near intersections of the scanning lines (or gate lines) and the signal line (or data lines), and each used as a switching element for selectively driving the corresponding pixel electrode. Each TFT has a gate connected to one scanning line, and a source-drain path connected between one signal line and one pixel electrode. The TFT is turned on in response to a rise of a scanning pulse from the scanning line, and supplies the pixel signal voltage to the pixel electrode from the signal line. The pixel electrode and the counter electrode are associated with the liquid crystal layer to constitute a liquid crystal capacitance to be charged according to the potential difference between these electrodes. This potential difference is maintained by the liquid crystal capacitance even after the TFT is turned off in response to a fall of the scanning pulse.

In a case where the electric field is kept in the same direction, materials other than the liquid crystal tend to gather one electrode side, thereby causing the life of the liquid crystal layer to be shortened. Conventionally, a technique of reversing the polarity of the pixel signal voltage with respect to the potential of the counter electrode every one frame period, for example, is known as a solution of the problem. If the polarity of the pixel signal voltage is reversed in the same manner for all the pixel electrodes during the frame period, this causes generation of flickers which deteriorate the image quality. To reduce the flickers, there is used a drive method of driving adjacent columns of the pixel electrodes by the pixel signal voltages of the different polarities. For example, for a certain frame period, pixel signal voltages of the negative polarity are applied to the pixel electrodes connected to the even-numbered signal lines, and signal voltages of the positive polarity are applied to the pixel electrodes connected to the odd-numbered signal lines. For a next frame period, pixel signal voltages of the negative polarity are applied to the pixel electrodes connected to the odd-numbered signal lines, and pixel signal voltages of the positive polarity are applied to the pixel electrodes connected to the even-numbered signal lines.

There is also known a drive method of further driving adjacent rows of the pixel electrodes by pixel signal voltages of the different polarities. For each frame period, pixel signal voltages of the positive polarity are applied to the odd rows of the pixel electrodes connected to the odd-numbered signal lines, and the even rows of the pixel electrodes connected to the even-numbered signal lines. Moreover, pixel signal voltages of the negative polarity are applied to the odd rows of the pixel electrodes connected to the even-numbered signal lines, and the even rows of the pixel electrodes connected to the odd-numbered signal lines.

With this drive method, the polarity of the pixel signal voltage is reversed for each of the pixel electrodes arranged two-dimensionally on the liquid crystal display screen. As a result, the flickers can be prevented from being visually recognized easily.

However, a voltage of about ±5 V is normally needed to control the liquid crystal. Due to this, it is necessary for a signal line driver to have a driving ability which can obtain a sufficient voltage accuracy in a large output dynamic range of 10 V. This causes an increase in power consumed by the liquid crystal display.

BRIEF SUMMARY OF THE INVENTION

An object of the present invention is to provide a liquid crystal display capable of reducing power consumption while maintaining an excellent display quality.

According to the first aspect of the present invention, there is provided a liquid crystal display which comprises a matrix array of pixels to be selected for each row, a plurality of signal lines connected to the pixels of a selected row, a plurality of D/A converters, arranged to correspond to the signal lines, for converting digital pixel signals externally supplied for the pixels of the selected row into analog pixel signals, an amplifying section for amplifying the pixel signals obtained from the D/A converters, and a switch section for outputting the pixel signals obtained from the amplifying section to the signal lines.

The amplifying section has groups of first and second amplifying circuits each for amplifying the pixel signals obtained from adjacent two of the D/A converters in the opposite polarities. The first amplifying circuit is connected to a positive power source to amplify the pixel signal in the positive polarity, and the second amplifying circuit is connected to a negative power source to amplify the pixel signal in the negative polarity. The switch section has groups of switch circuits each for causing two of the signal lines to be exchanged and output the pixel signals obtained from the first and second amplifying circuits.

According to the display constituted as mentioned above, since each amplifying circuit is operated in a single polarity, power consumption can be reduced. The D/A converters perform the digital-analog conversion without changing the polarity, accuracy of the conversion can be improved. Moreover, each set of the D/A converter and the amplifying circuit is used in common for adjacent two signal lines. Therefore, the circuitry size can be reduced.

According to the second aspect of the present invention, there is provided a liquid crystal display which comprises a matrix array of pixels to be selected for each row, a plurality of signal lines connected to the pixels of a selected row, a first video bus for transmitting an analog pixel signal of the positive polarity assigned to one of odd and even columns of the pixels present in the selected row, a second video bus for transmitting an analog pixel signal of the negative polarity assigned to the other one of the odd and even columns of the pixels present in the selected row, and groups of sample-hold circuits, arranged to correspond to the signal lines, for sequentially sample-holding the pixel signals transmitted by the first and second video buses. The sample-hold circuits of each group have a first switch circuit for causing the first and second video buses to be connected to one of adjacent two signal lines and the other of the adjacent two signal lines, and a second switch circuit for causing the first and second video buses to be connected to the other of the adjacent two signal lines and the one of the adjacent two signal lines. The first and second switch circuits are selectively turned on to simultaneously sample-hold the pixel signals transmitted by the first and second video buses and causing the two signal lines to be exchanged and output the pixel signals, respectively.

According to the display constituted as mentioned above, when the liquid crystal display is used to display a color image, the first and second video buses are used in common for color pixels (R-G, G-B, B-R) adjacent to each other in rows. Since each video bus transmits the pixel signal of a single polarity, power consumed due to the parasitic capacitance of the video bus can be reduced. Moreover, the adjacent signal lines can be driven by only these video buses. Such a decrease in the number of video buses enables to reduce the circuitry size.

DETAILED DESCRIPTION OF THE INVENTION

An active matrix liquid crystal display according to one embodiment of the present invention will now be described with reference to the accompanying drawings.

Figure 1:
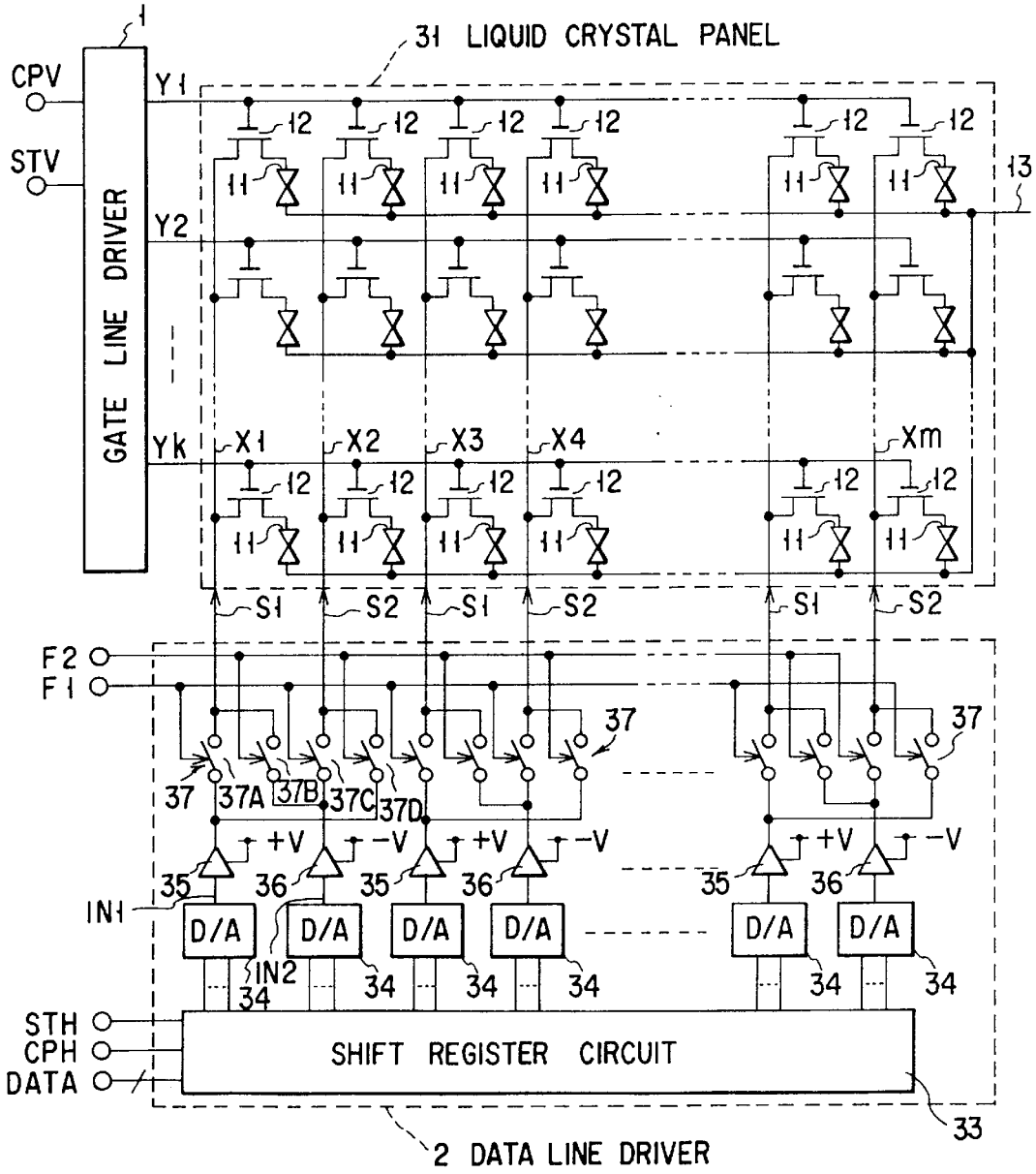
FIG. 1 is a circuit diagram of an active matrix liquid crystal display according to a first embodiment of the present invention.

FIG. 1 is a circuit diagram of the liquid crystal display. The liquid crystal display comprises a gate line driver 1, a data line driver 2, and a liquid crystal panel 31. The liquid crystal panel 31 has an array substrate and a counter substrate, each having a light transmitting property, and a liquid crystal layer which is held by the array and counter substrates and made of liquid crystal composition filled in the gap therebetween. The array substrate has a glass substrate, a matrix array of n×m pixel electrodes 11 formed on the glass substrate, n gate lines Y1 to Yn formed along rows of the pixel electrodes 11, m data, lines X1 to Xm formed along columns of the pixel electrodes 11, n×m thin film transistors (TFT) 12 formed near intersections of the gate lines Y1 to Yn and the data lines X1 to Xm as switching elements, and a first alignment film covering the entire matrix array of the pixel electrodes 20. The counter substrate has a glass substrate, a light shielding film formed to mask an area surrounding each pixel electrode 11, a color filter for filtering light to selectively transmit color components of red, green, and blue, a counter electrode 13 opposing to the matrix array of pixel electrodes 11, and a second alignment film covering the entire counter electrode 22. The first and second alignment films are provided for causing liquid crystal molecules to be set in a twisted nematic (TN) alignment when no potential difference exists between the pixel electrode 11 and the counter electrode 13. Each TFT 12 has a gate connected to one of the gate lines Y1 to Yn, and a source-drain path connected between one of the data lines X1 to Xm and one of the pixel electrodes 11. Each pixel electrode 11 is associated with the counter electrode 13 and the liquid crystal layer to constitute a liquid crystal capacitance CLC. Two polarizing plates are adhered onto the outer surfaces of the array and counter substrates to be right angles with each other. The gate line driver 1 and the data line driver 2 are located outside the matrix array of the pixel electrodes 11 in the glass surface of the array substrate.

The gate line driver 1 is controlled by control signals supplied from an external liquid crystal controller to perform an operation of sequentially driving the gate lines Y1 to Yn in each frame period. The control signals for the gate line driver 1 include a vertical start signal STV to be generated every one frame period and a vertical clock signal CPV to be generated every one horizontal scanning period. The operation of the gate line driver 1 is performed by use of a shift register circuit which shifts the vertical start signal STV in synchronism with the vertical clock signal CPV.

The data line driver 2 is controlled by control signals supplied from the external liquid crystal controller to perform an operation of sequentially driving the data lines X1 to Xn in each horizontal scanning period. The control signals for the data line driver 2 include a horizontal start signal STH to be generated every one horizontal scanning period, a digital video signal constituted by series items of pixel data DATA to be generated every one horizontal scanning period, a horizontal clock signal CPH to be generated for each pixel data DATA, and frame signals F1 and F2. The data line driver 2 comprises b shift register circuit 33, m D/A converters 34, m/2 first amplifying circuits 35, m/2 second amplifying circuits 36, and m/2 analog switches 37.

The shift register circuit 33 performs a serial-parallel conversion of pixel data DATA by shifting the horizontal start signal STH in synchronism with the horizontal clock signal CPH, latching pixel data DATA of a video signal at the time when the horizontal start signal STH is shifted, and outputting the pixel data DATA to the D/A converter 34 corresponding to the shift position of the horizontal start signal STH. The m D/A converters 34 are arranged to correspond to the data line X1 to Xm, and sample-hold pixel data DATA supplied from the shift register circuit 33 to convert each pixel data DATA to an analog pixel signal. The m/2 amplifying circuits 35 are connected commonly to a positive power line +V, and amplify the pixel signals from the odd-numbered D/A converters 34 in the positive polarity. The m/2 second amplifying circuits 36 are connected commonly to a negative power line −V, and amplify the pixel signals from the even-numbered D/A converters 34 in the negative polarity. In other words, the pixel signals from the adjacent two D/A converters 34 are amplified by the amplifying circuits 35 and 36 in the opposite polarities. The m/2 analog switches 37 are connected to the m/2 amplifying circuits 35 and 36. Each analog switch 37 is controlled by frame signals F1 and F2 supplied from the external liquid crystal controller, and supplies the pixel signals of the opposite polarities obtained from the amplifying circuits 35 and 36 of the corresponding group, to the adjacent two data lines, alternatively.

More specifically, the frame signal F1 is set to be in a high level for a preceding frame period of two continuous frame periods, and to be in a low level for a following frame period of the two frame periods. The frame signal F2 is set to be in a low level for the preceding frame period of the two continuous frame periods, and to be in a high level for the following frame period of the two frame periods. Each analog switch 37 comprises first to fourth switching elements 37A to 37D. The first switching element 37A is connected between one first amplifying circuit 35 and one odd-numbered data line. The second switching element 37B is connected between one second amplifying circuit 36 and the odd-numbered data line. The third switching element 37C is connected between the second amplifying circuit 36 and one even-numbered data line. The fourth switching element 37D is connected between the first amplifying circuit 35 and the even-numbered data line. The switching elements 37A and 37C cause the amplifying circuits 35 and 36 to be electrically connected to the odd-numbered data line and the even-numbered data line when the frame signal F1 is in a high level, and to be electrically disconnected from the odd-numbered data line and the even-numbered data line when the frame signal F1 is in a low level. The switching elements 37B and 37D cause the amplifying circuits 36 and 35 to be electrically connected to the odd-number data line and the even-numbered data line when the frame signal F2 is in a high level, and to be electrically disconnected from the odd-numbered data line and the even-numbered data line when the frame signal F2 is in a low level. To correctly assign pixel signals to the pixels arranged in rows, the external liquid crystal controller has a memory for storing series items of pixel data to be supplied to the shift register circuit 33, and reverses the order of every two adjacent pixel data items the preceding or following frame period.

In the preceding frame period, pixel signals of the positive polarity are output from the m/2 first amplifying circuits 35 to the data lines X1, X3, X5 . . . , and pixel signals of the negative polarity are output from the m/2 second amplifying circuits 36 to the data lines X2, X4, X6, X8 . . . . In the following frame period, pixel signals of the negative polarity are output from the second amplifying circuit 36 to the data lines X1, X3, X5, . . . , and pixel signals of the positive polarity are output from the first amplifying circuit 35 to the data lines X2, X4, X6, . . . . The destination of the pixel signals of the positive and negative polarities is changed between the pair of the data lines X1 and X2, the pair of the data lines X3 and X4, and the pair of the data lines X5 and X6 every one frame period. In other words, the pair of the data lines X1 and X2, the pair of the data lines X3 and X4, and the pair of the data lines X5 and X6 are driven in a V-line reverse manner by the pixel signals of the positive and negative polarities which are reversed every one frame period.

Figure 2:
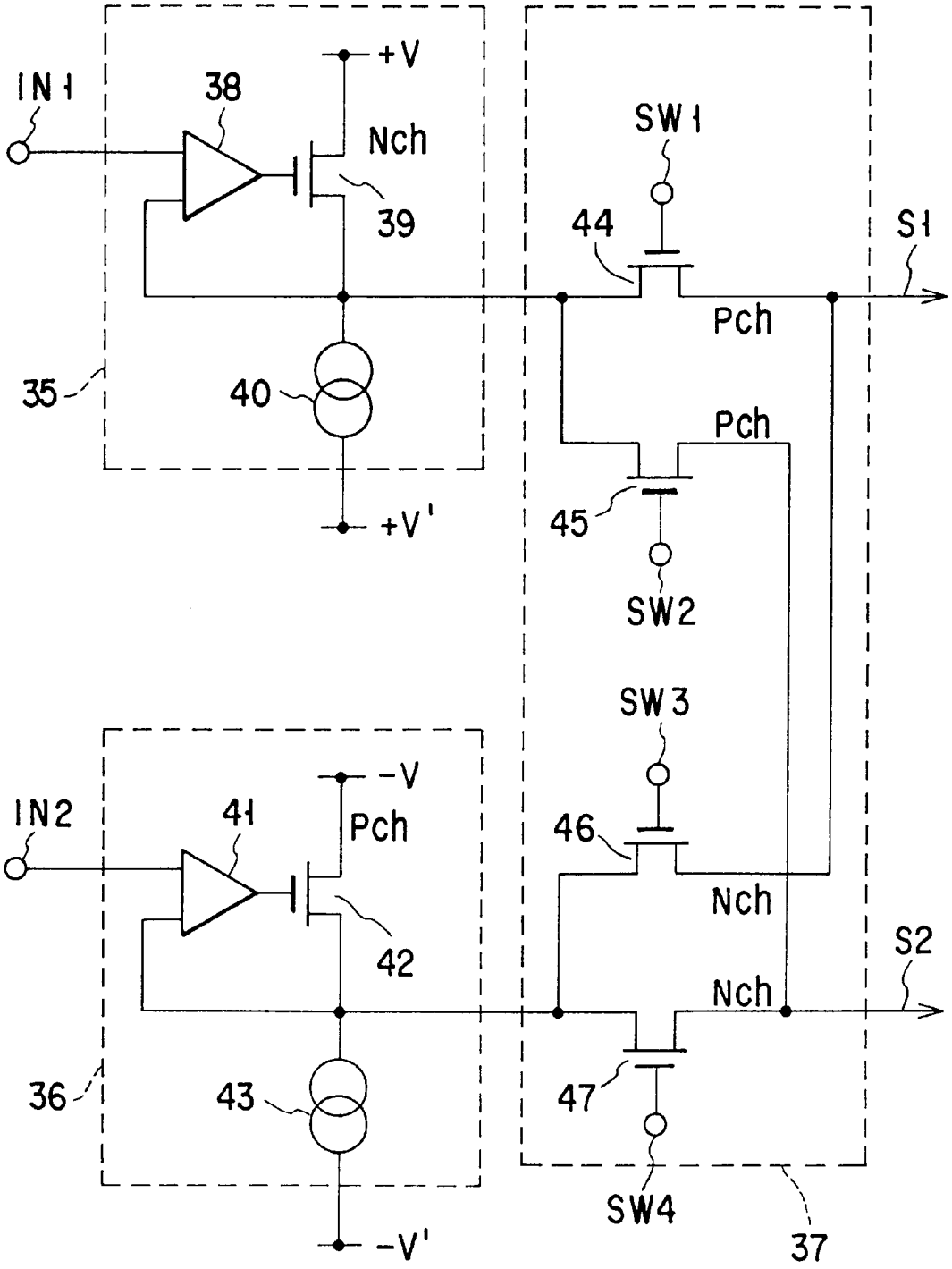
FIG. 2 is a circuit diagram showing a main structure of a data line driver shown in FIG. 1.

FIG. 2 shows the main structure of the data line driver 2 shown in FIG. 1. Input terminals IN1 and IN2 are connected to receive the pixel signals supplied from the adjacent two D/A converters 34. The first amplifying circuit 35 comprises a differential amplifier 38, an N-channel transistor 39, and a constant current source 40. The drain of the transistor 39 is connected to a positive power line +V, and the source thereof is connected to a power line +V' through the constant current source 40. The source output of the transistor 39 is fed back to the differential amplifier 38. On the other hand, the second amplifying circuit 36 comprises a differential amplifier 41, a P-channel transistor 42, and a constant current source 43. The drain of the transistor 42 is connected to a negative power line −V, and the source thereof is connected to a power line −V' through the constant current source 43. The source output of the transistor 42 is fed back to the differential amplifier 41. Regarding the labels such as "+V" and "−V", the potential polarities are not determined directly from the ground potential, and determined from a reference potential depending on the center level between the power line potentials. Actually, the power line potentials are set to +V=10 V, −V=5 V, +V'=5 V, and −V'=0 V. According to the above-mentioned structure, the first amplifying circuit 35 amplifies the pixel signal input from the input terminal IN1 and outputs the pixel signal whose polarity is positive with respect to the reference potential. The second amplifying circuit 36 amplifies the pixel signal input from the input terminal IN2 and outputs the pixel signal whose polarity is negative with respect to the reference potential.

The analog switch 37 comprises P-channel transistors 44, 45 and N-channel transistors 46 and 47, which are formed as switching elements 37A, 37D, 37B, and 37C, respectively. The gate of the transistor 44 is connected to a terminal SW1 which receives an inverted signal (or F2) of the frame signal F1. The gate of the transistor 45 is connected to a terminal SW2 which receives an inverted signal (or F1) of the frame signal F2. The gate of the transistor 46 is connected to a terminal SW3 which receives the frame signal F2. The gate of the transistor 47 is connected to a terminal SW4 which receives the frame signal F2. For the frame period in which the frame signal F1 is set to be in a high level and the frame signal F2 is set to be in a low level, the P-channel transistor 44 and the N-channel transistor 47 are turned on, and the P-channel transistor 45 and the N-channel transistor 46 are turned off. At this time, the pixel signal from the first amplifying circuit 35 is output to the odd-numbered data line through the output terminal S1. The output signal of the second amplifying circuit 36 is output to the even-numbered data line through the output terminal S2.

On the other hand, for the frame period in which the frame signal F1 is set to be in a low level and the frame signal F2 is set to be a high level, the P-channel transistor 45 and the N-channel transistor 46 are turned on, and the P-channel transistor 44 and the N-channel transistor 47 are turned off. At this time, the pixel signal from the first amplifying circuit 35 is output to the even-numbered data line through the output terminal S2. The output signal of the second amplifying circuit 36 is output to the odd-numbered data line through the output terminal S1.

According to the above-explained embodiment, the pixel signals output from the first amplifying circuits 35 are always set to have the positive polarity. The pixel signals output from the first amplifying circuits 36 are always set to have the negative polarity. Due to this, the dynamic ranges of the amplifying circuits 35 and 36 can be determined based on the necessary liquid crystal drive voltage without considering the reversion of the voltage polarity. As a result, electrical power can be prevented from be wastefully consumed by the amplifying circuits. Moreover, each D/A converter 34 may generate a voltage in that one of the positive and negative polarities which conform to the voltage polarity of the pixel signal output from the corresponding amplifying circuit 35 or 36. As a result, the accuracy of the D/A conversion can be improved as reducing the power consumption.

The liquid crystal display of this embodiment may be constituted to perform an HV reverse drive in which the voltage polarities of the pixel signals to be applied to the data lines are additionally reversed every row. In this case, the analog switches 37 may be controlled by signals which are reversed every one horizontal scanning period, in place of the frame signals F1 and F2. In this driving form, the voltages applied to the liquid crystal pixels in adjacent rows and adjacent columns differ from each other. This increases a spatial frequency, thereby further suppressing the image deterioration such as flickers and a line scroll.

Moreover, the transistors 44 to 47 shown in FIG. 2 may be formed of CMOS transistors. The transistors included in the analog switch 37 and the amplifying circuits 35 and 36 may be formed of thin film transistors (TFT), which are formed on the array substrate together with the thin film transistors allocated to the respective pixel electrodes 11. These thin film transistor may be formed of well-known staggered type TFTs. In this case, each thin film transistor is obtained by forming a polycrystalline silicon layer of a predetermined shape on the glass substrate, forming a silicon oxide film covering the entire surface of the polycrystalline silicon layer and serving as a gate insulating film, forming a gate electrode united with the gate line Y1, Y2, . . . , or Yn on the gate insulating film, and forming a source electrode united with data line X1, X2, . . . , or Xm and a drain electrode of the same layer as the source electrode, on the gate electrode via an interlayer insulating film. Moreover, the shift register circuit 33 may be obtained by combining well-known flip-flop circuits having TFT elements formed on the array substrate together with the thin film transistors 12 allocated to the pixel electrodes 11.

In the case where the transistors have a common structure in the liquid crystal display, the required number of manufacturing steps is reduced. Therefore, it is possible to manufacture the liquid crystal display with low cost.

A modification of the data line driver shown in FIG. 1 will be described with reference to FIG. 3:

In the first embodiment, the order of every adjacent two pixel data items was reversed in the memory of the external liquid crystal controller to allocate the pixel signals to the pixels arranged in rows within the successive two frame periods. Regarding the modification shown in FIG. 3, the shift register circuit 33 is structured such that the order of the pixel data items to be supplied to every adjacent two D/A converters 34 is reversed every one frame period.

Figure 3:
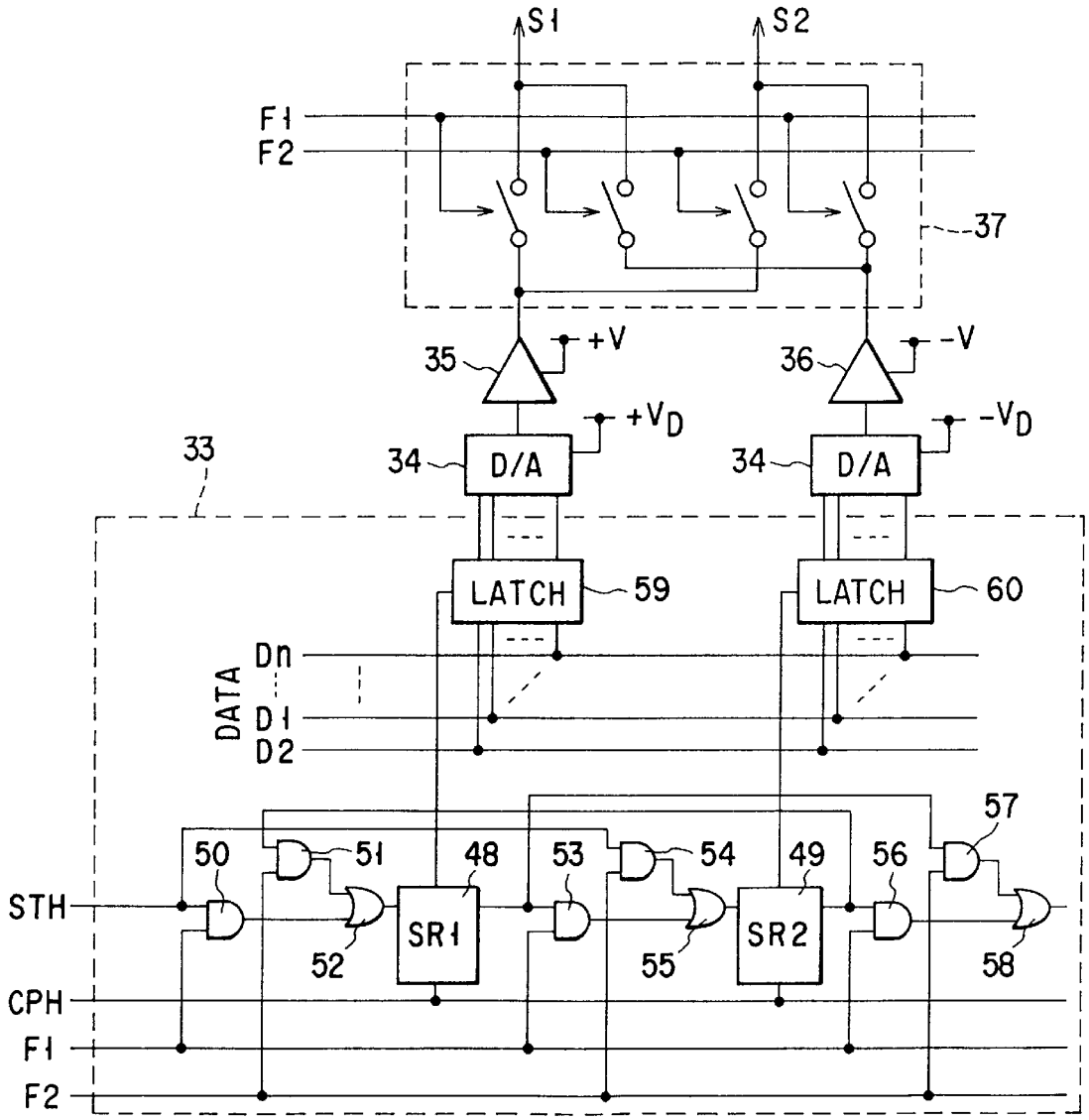
FIG. 3 is a circuit diagram for explaining a modification of the data line driver shown in FIG. 1.

FIG. 3 specifically shows that part of the data line driver 2 which drives the first and second data lines. The horizontal start signal STH is supplied to registers 48 and 49 in a forward or opposite order through logic gates 50 to 55 controlled by the frame signals F1 and F2.

For the preceding period in which the frame signal F1 is set to be in a high level and the frame signal F2 is set to be in a low level, the AND gates 50, 53, and 56 are opened, and the AND gates 51, 54, and 57 are closed. As a result, the horizontal start signal STH is supplied to the register 48 through the AND gate 50 and the OR gate 52. The output of the register 48 is directly supplied to a latch 59 on one hand, and to the register 49 through the AND gate 53 and the OR gate 55 on the other hand. Thereby, the horizontal start signal STH is transferred to the registers 48, 49, . . . in this order, in synchronism with the horizontal clock signal CPH. Latches 59, 60, . . . latch pixel data DATA on data buses D1 . . . Dn at timing when the horizontal start signal STH is held and output by the respective registers 48, 49, . . . . Then, the latched pixel data DATA are supplied to the corresponding D/A converters 34.

For the following period in which the frame signal F1 is set to be in a low level and the frame signal F2 is set to be in a high level, the AND gates 51, 54, and 57 are opened, and the AND gates 50, 53, and 56 are closed. As a result, the horizontal start signal STH is supplied to the register 49 through the AND gate 54 and the OR gate 55. The output of the register 49 is directly supplied to the latch 60 on one hand, and to the register 48 through the AND gate 51 and the OR gate 52 on the other hand. Thereby, the horizontal start signal STH is transferred to the registers 49, 48, . . . in this order. In other words, as compared with the preceding frame period, the output order of the odd- and even-numbered registers is reversed.

The operations of the D/A converters 34, the amplifying circuits 35 and 36, and the switches 37 are the same as the case of the first embodiment.

According to the above-mentioned modification, the pixel signals of the positive and negative polarities are correctly allocated to the pixels arranged in rows without reversing the order of pixel data items outside the display to perform the polarity reverse drive. Therefore, the circuit required for reversing the order of the pixel data items outside the display can be eliminated.

Figure 4:
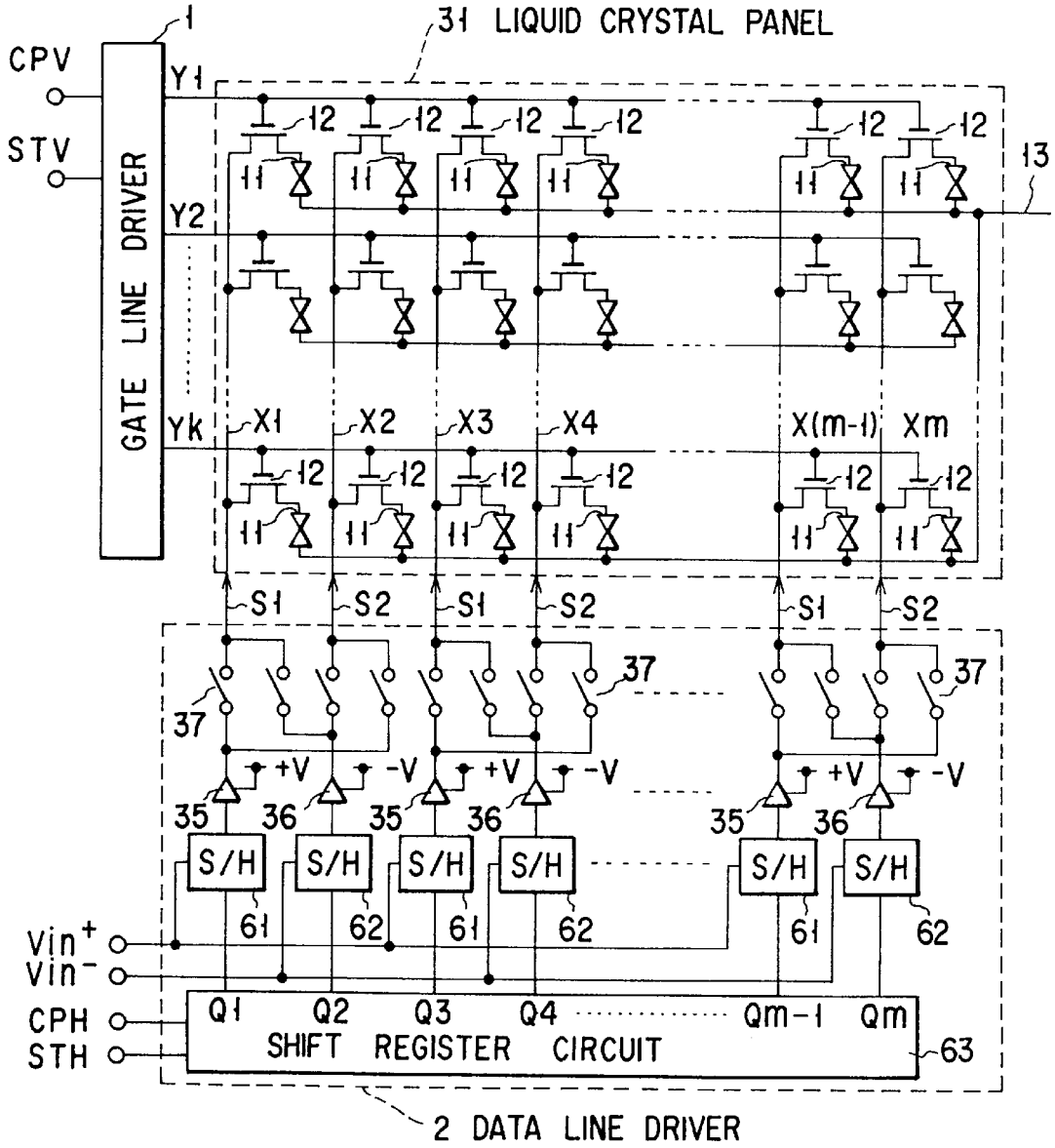
FIG. 4 is a circuit diagram of an active matrix liquid crystal display according to a second embodiment of the present invention.

An active matrix liquid crystal display according to the second embodiment of the present invention will be described with reference to FIG. 4. The liquid crystal display has substantially the same structure as that of the display shown in FIG. 1 except for the data line driver 2. In FIG. 4, the portions common to the first embodiment are shown by the same reference numerals, and the explanation is omitted.

The data line driver 2 shown in FIG. 4 performs a serial-parallel conversion on analog pixel signals supplied from the external liquid crystal controller by use of sample-hold circuits. In the data line driver 2, a shift register circuit 63 has m registers connected in series such that the horizontal start signal STH is shifted in synchronism with the horizontal clock signal CPH. Register outputs Q1, Q2, Q3, . . . Qm are connected to m sample-hold circuits 61 and 62 arranged to correspond to the data lines X1, X2, X3, . . . Xm. These registers are connected to each other as shown in FIG. 3 such that the output order of the odd and even-numbered registers is reversed.

In FIG. 4, 61 denotes m/2 odd-numbered sample-hold circuits, and 62 denotes m/2 even-numbered sample-hold circuits. The sample-hold circuits 61 are connected to a video bus Vin+ which transmits an RGB analog video signal of the positive polarity, so as to sample-hold the analog video signal in response to each horizontal start signal from the register output terminals Q1, Q3, Q5, . . . , Qm−1 and supply them to the odd-numbered amplifying circuits 35 as pixel signals. The sample-hold circuits 62 are connected to a video bus Vin− which transmits an RGB analog video signal of the positive polarity, so as to sample-hold the analog video signal in response to each horizontal start signal from the register output terminals Q2, Q4, Q6, . . . , Qm and supply them to the even-numbered amplifying circuits 36 as pixel signals. The amplifying circuits 35 are connected commonly to the positive power line +V to amplify the pixel signals from the odd-numbered sample-hold circuits 61 in the positive polarity. The second amplifying circuits 36 are connected commonly to the negative power line −V to amplify the pixel signals from the even-numbered sample-hold circuits 62 in the negative polarity. In other words, the pixel signals from the adjacent two sample-hold circuits 61 and 62 are amplified by the amplifying circuits 35 and 36 in the opposite polarities. The m/2 analog switches 37 are, connected to m/2 groups of amplifying circuits 35 and 36. Each analog switches 37 are controlled by the external liquid crystal controller in the same manner as that of the first embodiment, so as to supply the pixel signals of the opposite polarities obtained from the amplifying circuits 35 and 36 of the corresponding group to the adjacent two data lines, alternatively.

According to the above-mentioned structure, for the frame period in which the frame signal F1 is set to be in a high level and the frame F2 is set to be in a low level, the horizontal start signal STH is output from the shift register circuit 63 in the order of Q1, Q2, Q3, . . . , Qm, so as to enable the sample-hold operation. As a result, the sample-hold circuits 61 and 62 sample-hold the video signals on the video buses Vin+ and Vin− in their order. Since the operations of the analog switches 37 are the same as those in the first embodiment, the pixel signals of the positive polarity are supplied to the odd-numbered data lines X1, X3, X5, . . . through the amplifying circuits 35, and the voltages of the negative polarity are supplied to the even-numbered data lines X2, X4, X6, . . . through the amplifying circuits 36.

For the frame period in which the frame signal F1 is set to be in a low level and the frame F2 is set to be in a high level, the horizontal start signal STH is output from the shift register circuit in the order of Q2, Q1, Q4, Q3, . . . , so as to enable the sample-hold operation. As a result, the operation order of the sample-hold circuits 61 and 62 corresponding to the adjacent two data lines in this frame period is opposite to the preceding frame period. Since the operations of the analog switches 37 are the same as those in the first embodiment, the voltages of the negative polarity are supplied to the odd-numbered data lines X1, X3, X5, . . . through the amplifying circuits 35, and the voltages of the positive polarity are supplied to the even-numbered data lines X2, X4, X6, . . . through the amplifying circuits 36.

According to the above-mentioned embodiment, the pixel signals output from the first amplifying circuits 35 are always set to have the positive polarity, and the pixel signals output from the second amplifying circuits 36 are always set to have the negative polarity. Due to this, the dynamic ranges of the amplifying circuits 35 and 36 can be determined based on the necessary liquid crystal drive voltage without considering the reversion of the voltage polarity. As a result, electrical power can be prevented from be wastefully consumed by the amplifying circuits.

Figure 5:
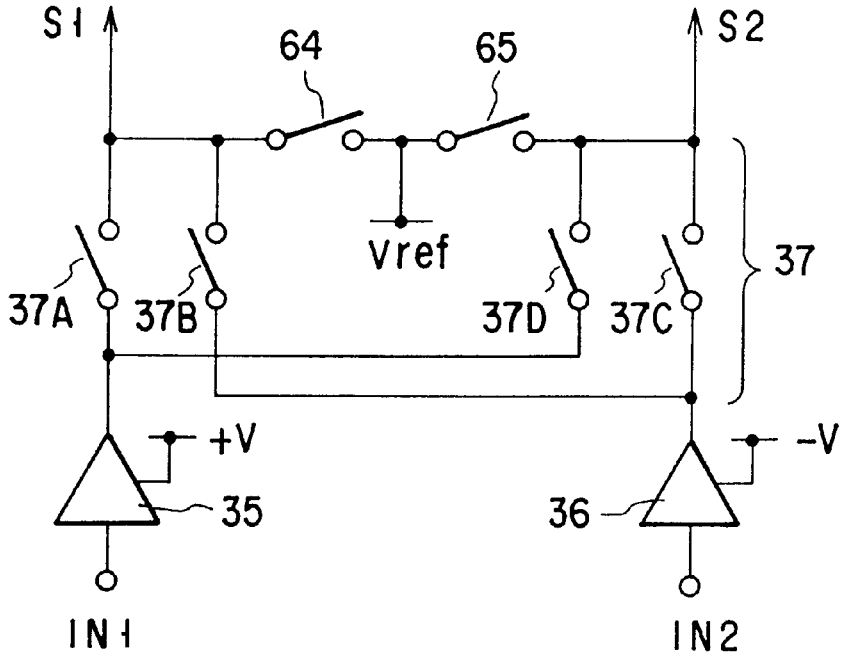
FIG. 5 is a circuit diagram for explaining a first modification of the data line driver shown in FIG. 4.

The first modification of the data line driver 2 shown in FIG. 4 will be explained with reference to FIG. 5.

In this modification, each analog switch 37 is structured to further comprise a switching element 64 connected between the output terminal S1 and a reference power line Vref, and a switching element 65 connected between the output terminal S2 and the reference power line Vref. The reference power line Vref is set to be a reference potential equal to an intermediate level between the potential of the positive power line +V and the potential of the negative power line −V. In operation, all switching elements 37A to 37D are opened immediately before the pixel signals of the positive and negative polarities are output to the adjacent two data lines through the output terminals S1 and S2. During this time, the switching elements 64 and 65 are closed. The switching elements 64 and 65 discharge electric charges stored in the parasitic capacitances of the two data lines, and set the data lines to be potentials equal to the reference voltage. Thereafter, when the pixel signals of the positive and negative polarities are output from the first and second amplifying circuits 35 and 36, these data lines are charged from the reference potential to potentials corresponding to the pixel signals.

According to the above-mentioned structure, the amplifying circuits 35 and 36 can perform charging of each data line with a reduced driving ability. That is, an excellent operation reliability can be obtained without making the structure of amplifying circuits 35 and 36 complicated in consideration of the withstanding voltage. Regarding the circuit other than the analog switches 37, it can be formed in the same structure as the first embodiment or the third embodiment.

Figure 6:
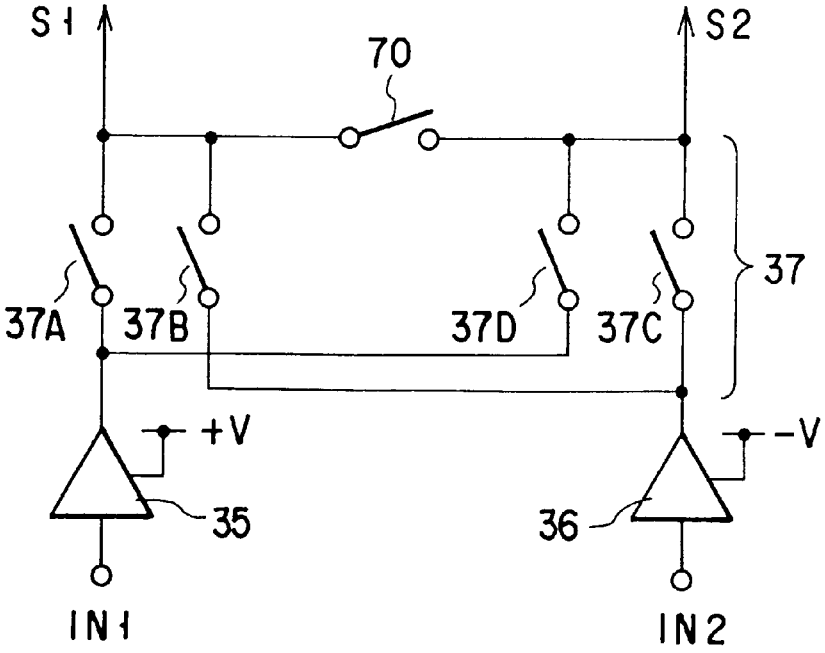
FIG. 6 is a circuit diagram for explaining a second modification of the data line driver shown in FIG. 1.

The second modification of the data line driver 2 shown in FIG. 4 will be explained with reference to FIG. 6.

In this modification, each analog switch 37 is structured to further comprise a switching element 70 connected between the output terminals S1 and S2. Similar to the first embodiment, the data line driver 2 performs the polarity reversion of the liquid crystal signal voltage by causing the outputs of the first and second amplifying circuits 35 and 36 to be exchanged. More specifically, all the switching elements 37A to 37D are opened immediately before the pixel signals of the positive and negative polarities are output to the adjacent two data lines through the output terminals S1 and S2. During this time, the switching element 70 is closed. The switching element 70 discharges electric charges stored in the parasitic capacitances of the two data lines, and set the data lines to be the same, potentials, which are substantially equal to the reference voltage Vref. Thereafter, when the pixel signals of the positive and negative polarities are output from the first and second amplifying circuits 35 and 36, these data lines are charged from the reference potential to potentials corresponding to the pixel signals.

According to the above-mentioned structure, the amplifying circuits 35 and 36 can perform charging of each data line with a reduced driving ability. That is, an excellent operation reliability can be obtained without making the structure of amplifying circuits 35 and 36 complicated in consideration of the withstanding voltage. Moreover, since a potential difference can be canceled by the charges moving from one of the adjacent data lines to the other, power consumption can be reduced.

Figure 7:
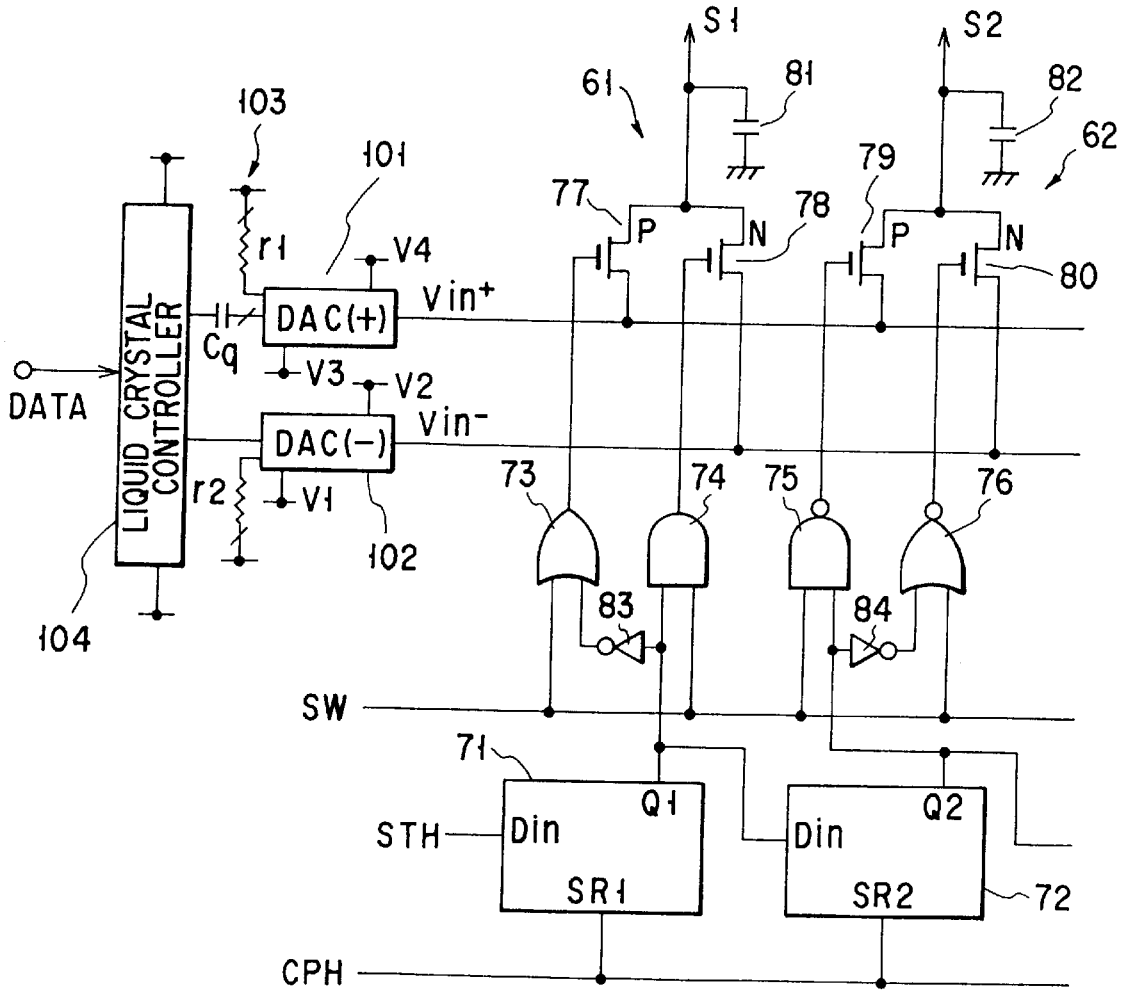
FIG. 7 is a circuit diagram for explaining a third modification of the data line driver shown in FIG. 4.

The third modification of the data line driver 2 shown in FIG. 4 will be explained with reference to FIG. 7.

In this modification, the switches 35 shown in FIG. 4 are eliminated. Instead, each of m sample-hold circuits 61 and 62 is connected to both video buses Vin+ and Vin−. The sample-hold circuit 61 has a P-channel transistor 77 connected between the video bus Vin+ and the output terminal S1, and an N-channel transistor 78 connected between the video bus Vin− and the output terminal S1. The sample-hold circuit 62 has a P-channel transistor 79 connected between the video bus Vin− and the output terminal S2, and an N-channel transistor 80 connected between the video bus Vin− and the output terminal S2. In FIG. 7, 81 and 82 denote parasitic capacitances of the data lines which are respectively connected to the output terminals S1 and S2 and serve to hold the voltages of the pixel signals output from the output terminals S1 and S2.

The video line Vin+ is driven by a D/A converter 101, and the video line Vin− is driven by a D/A converter 102. These D/A converters 101 and 102 are provided outside the array substrate and formed to have the same structure.

The gate of the P-channel transistor 77 is connected to the output terminal of an OR gate 73, and the gate of the N-channel transistor 78 is connected to the output terminal of an AND gate 74. The gate of the P-channel transistor 79 is connected to the output terminal of a NAND gate 75, and the gate of the N-channel transistor 80 is connected to the output terminal of a NOR gate 76.

The OR gate 73, AND gate 74, NAND gate 75, and NOR gate 76 are connected to receive a switching signal SW. The AND gate 74 is connected to the output terminal of a register 71, and the NAND gate 75 is connected to the output terminal of a register 72. The OR gate 73 is connected to the output terminal of the register 72 through an inverter 83, the NOR gate 76 is connected to the output terminal of the register 72 through an inverter 84. The registers 71 and 72 are connected in series with each other so as to constitute the shift register circuit for sequentially shifting the horizontal start signal STH in synchronism with the horizontal clock CPH.

The above-structured data line driver 2 operates as follows:

If the switching signal SW is in a low level, the OR gate 73 is set to a state that the signal is passed therethrough, the output of the AND gate 74 is in a low level, the output of the NAND gate 75 is in a high level, and the NOR gate 76 is set to a state that the signal is reversed and passed therethrough. Therefore, the P-channel transistor 77 is set to be in a conductive state by the output of the register 71, and the N-channel transistor 78 and the P-channel transistor 79 are turned off. The N-channel transistor 80 is set to be in a conductive state by the output of the register 71. As a result, the video signal Vin+ of the positive polarity is output to the output terminal S1 based on the output of the register 71. The video signal Vin− of the negative polarity is output to the output terminal S2 based on the output of the register 72.

If the switching signal SW is in a high level, the OR gate 73 is in a high level, the AND gate 74 is set to a state that the signal is passed therethrough, the output of the NAND gate 75 is set to a state that the signal is reversed and passed therethrough, and the output of the NOR gate 76 is in a low level. Therefore, the P-channel transistor 77 is turned off, and the N-channel transistor 78 is set to be in a conductive state by the output of the register 71. The P-channel transistor 79 is set to be in a conductive state by the output of the register 72, and the N-channel transistor 80 is turned off. As a result, the video signal Vin− of the negative polarity is output to the output terminal S1 based on the output of the register 71. The video signal Vin+ of the positive polarity is output to the output terminal S2 based on the output of the register 72.

Accordingly, the video signal Vin+ of the positive polarity and the video signal Vin− of the negative polarity are alternatively output to the output terminals S1 and S2 in accordance with the change of the switching signal SW. Thereby, the liquid crystal pixels are driven by the voltages whose polarity is periodically reversed.

In this case, the respective logic gates 73 to 76, 83, 84, and the respective switching elements 77 to 78 may be formed of the well-known TFT structure. Moreover, the registers 71 and 72 may be formed of TFT elements combined to serve as a well-known flip-flop circuit. In this case, similar to the first embodiment, the manufacturing cost of the liquid crystal display can be reduced by commonly forming these transistor elements together with the thin film transistors for the pixel electrodes, in the same step.

Figure 8:
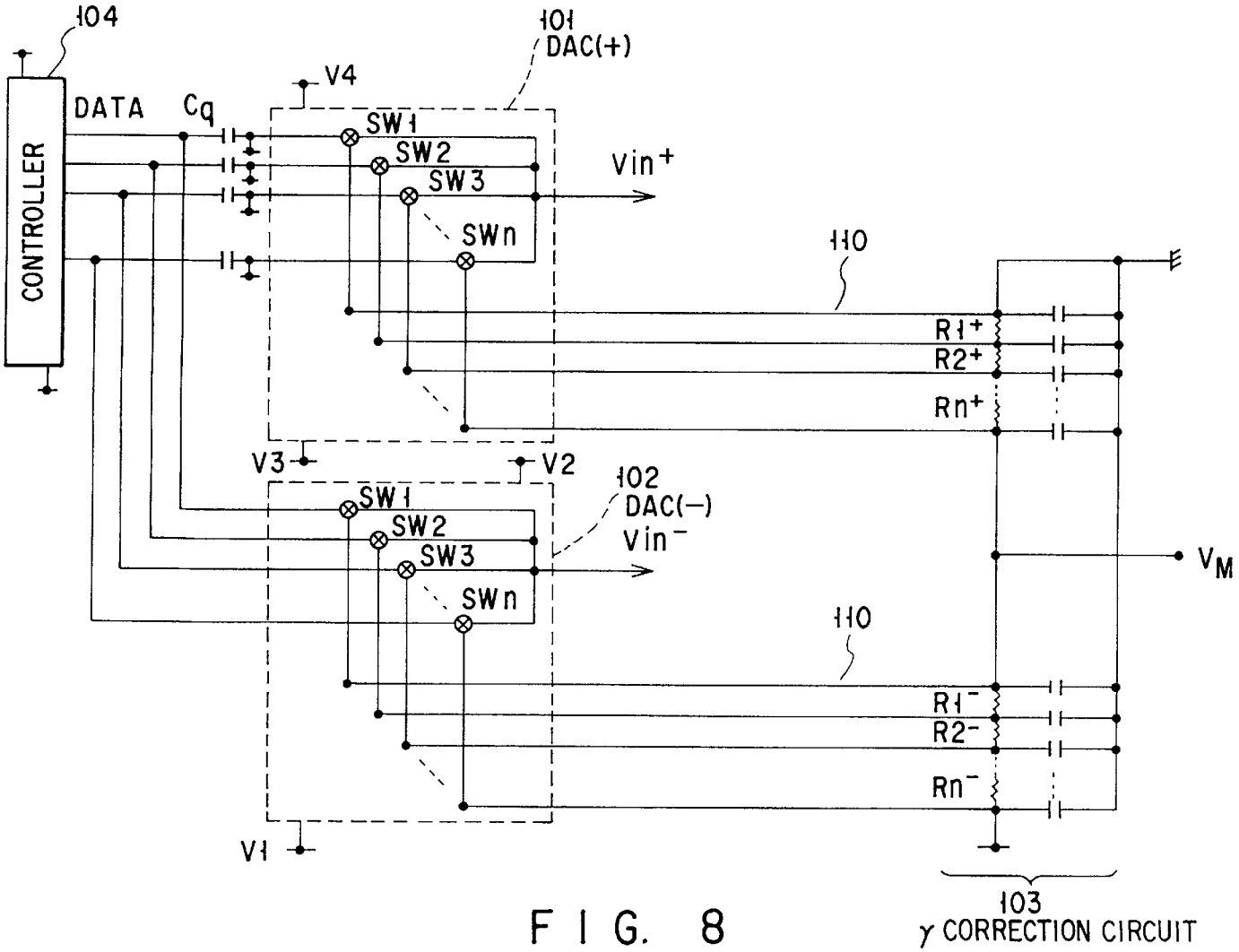
FIG. 8 is a circuit diagram showing D/A converters shown in FIG. 7 along with their peripheral circuits, in detail.

FIG. 8 shows the D/A converters 101 and 102 along with their peripheral circuits, in detail. The D/A converters 101 and 102 are of a voltage selection type. Specifically, each of the D/A converters 101 and 102 are connected to commonly receive pixel data DATA output from an external liquid crystal controller 104, and has a set of analog switches SW1 to SWn to be switched on the basis of the pixel data. The analog switches SW1 to SWn combines voltages generated from γ correction circuit 103 and supplied through analog signal lines 110 to output an analog pixel signal of a voltage level corresponding to pixel data DATA to the video bus Vin+ or Vin−.

As shown in FIG. 8, the D/A converter 101 is formed to operate under a voltage between the power lines which are respectively set to 3 V and 4 V. The D/A converter 102 is formed to operate under a voltage between the power lines which are respectively set to 1 V and 2 V. In this case, the threshold voltage of the analog switches SW1 to SWn of the D/A converter 101 differs from those of the D/A converter 102. Therefore, capacitors Cq are inserted between the liquid crystal controller 104 and the D/A converter 101 to attain capacitive couplings therebetween. Then, a bias voltage is applied to one end of each of capacitors Cq. The bias voltage is regulated such that the voltage level of input pixel data matches the threshold level of the analog switches SW1 to SWn. Therefore, the D/A converters 101 and 102 of the same structure can operate under different operation voltages. In this modification, the bias voltage is applied to the capacitors Cq. However, dummy data for charging the capacitors Cq may be input toward the capacitors Cq before inputting pixel data. Thereby, the voltage level of data can be adjusted without applying a special bias voltage.

Moreover, the γ correction circuit 103 comprises resisters R1+ to Rn+ and R1− to Rn− connected in series. Since an optical response of the liquid crystal material slightly differs depending on the positive and negative voltages, γ correction must be made in each of the drive voltage of the positive polarity and the drive voltage of the negative polarity. Due to this, a potential terminal VM which is connected to a central point between the series circuit of resistors R1+ to Rn for the γ correction to the voltage of the positive polarity and the series circuit of resistors R1− to Rn− for the γ correction to the voltage of the negative polarity, and the potential of the potential terminal is controlled, so as to determine the voltages across the circuit of the resistors R1+ to Rn+ and the circuit of the resistors R1− to Rn−.

The fourth modification of the data line driver 2 shown in FIG. 7 and serving as a color display will be explained with reference to FIG. 9.

In this modification, analog pixel signals of R1 (Red), G1 (Green), B1 (Blue), R2 (Red), G2 (Green), B2 (Blue), . . . are sequentially output to data lines X1, X2, X3, X4, X5, X6, . . . P-channel TFTs 77 and 79 for driving the data lines X1, X2, X5, X6 are connected commonly to an output video line V1+ of the D/A converter 101. N-channel TFTs 78 and 80 for driving the data lines X1, X2, X5, X6 are connected commonly to an output video line V1− of the D/A converter 102. P-channel TFTs 77 and 79 for driving the data lines X3, X4 are connected commonly to an output video line V2+ of the D/A converter 101. N-channel TFTs 78 and 80 for driving the data lines X3, X4 are connected commonly to an output video line V2− of the D/A converter 102. The gates of the P-channels 77 and 79 and N-channel TFTs for driving the data lines X1 to X4 are connected to the common register 71 through logic circuits 73 to 76. Regarding the data line 7 and the following data lines, they are arranged such that the above-mentioned structure is periodically repeated, and each group of TFTs for driving four data lines commonly receives an output signal from the corresponding register.

The operation of the data line driver 2 will be explained. For example, in the case of data lines X1, X2, similar to the modification shown in FIG. 6, an enable signal is input to the P-channel TFT 77 for driving the data line X1 and the N-channel TFT 80 for driving the data line X2 at common timing by the logic gates 73 and 76. Therefore, the signal voltage on the video line V1+ is supplied to the data line X1 through the P-channel TFT 77. At the same time, the signal voltage on the video line V1− is supplied to the data line X2 through the P-channel TFT 80. Moreover, an enable signal is input to the P-channel TFT 77 for driving the data line X3 and the N-channel TFT 80 for driving the data line X2 at common timing. Therefore, the signal voltage on the video line V2+ is supplied to the data line X3 through the P-channel TFT 77. At the same time, the signal voltage on the video line V2− is supplied to the data line X4 through the P-channel TFT 80.

Figure 9:
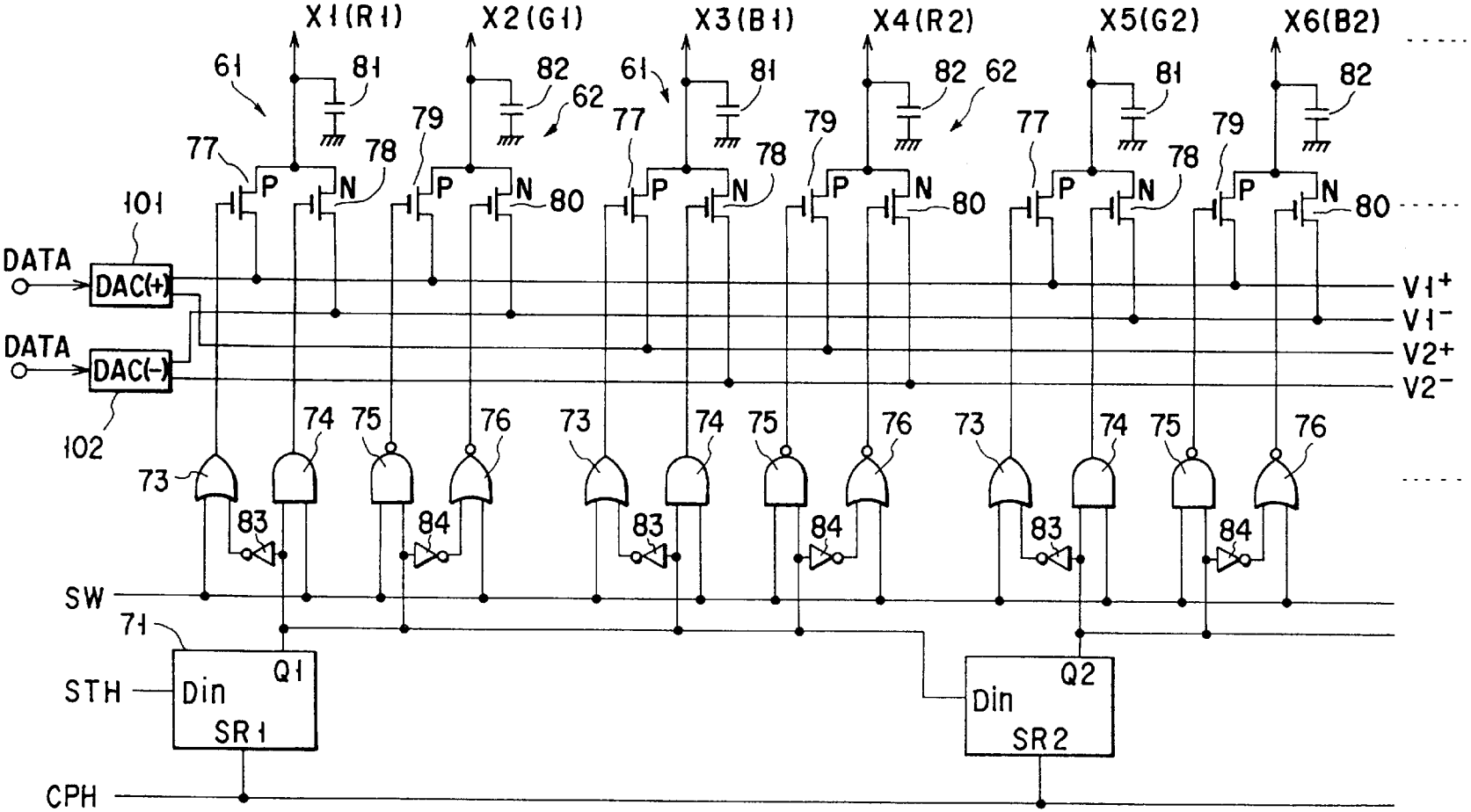
FIG. 9 is a circuit diagram for explaining a fourth modification in which the data line driver shown in FIG. 7 is applied to a color display.
Figure 10:
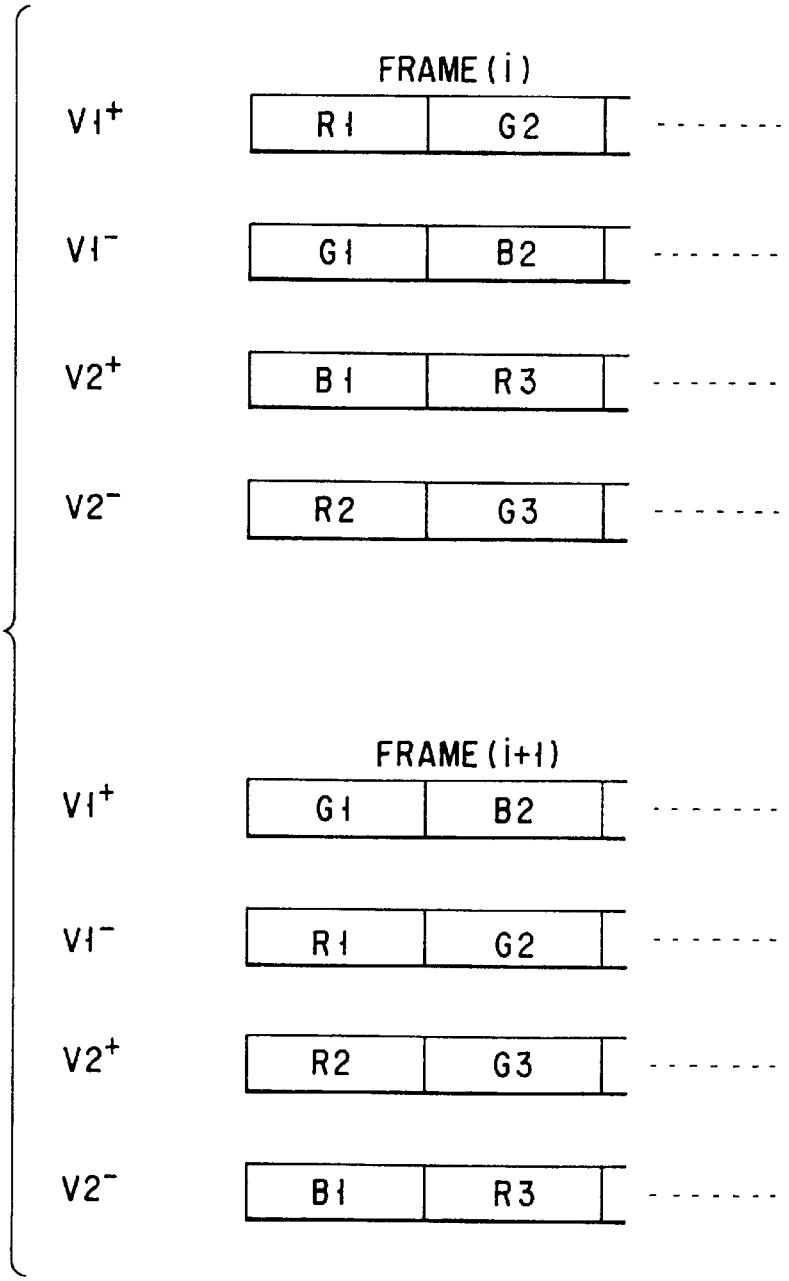
FIG. 10 is a view showing pixel data streams to be supplied to the data line driver shown in FIG. 9.

FIG. 10 shows pixel data streams to be supplied to the two D/A converters 101 and 102 from the liquid crystal controller shown in FIG. 9.

For an i-th frame period, the data stream of pixel data R1 for data line X1, pixel data G2 for data line; X5, . . . is input to the D/A converter 101 to drive the video line V1+. The data stream of pixel data G1, B2, . . . is input to the D/A converter 102 to drive the video line V1−. The data stream of pixel data B1, R3, . . . is input to the D/A converter 101 to drive the video line V2+. Moreover, the data stream of pixel data R2, G3, . . . is input to the D/A converter 102 to drive the video line V2−. The D/A converter 101 converts each of pixel data R1, G2, . . . to an analog pixel signal of the positive polarity to be supplied to the video line V1+, and also converts each of pixel data B1, R3, . . . to an analog pixel signal of the positive polarity to be supplied to the video line V2+. On the other hand, the D/A converter 102 converts each of pixel data G1, B2, . . . to an analog pixel signal of the negative polarity to be supplied to they video line V1−, and also converts each of pixel data R2, G3, . . . to an analog pixel signal of the negative polarity to be supplied to the video line V2−.

For a next (i+1)-th frame period, the data stream of pixel data G1 for data line X2, pixel data B2 for data line X6, . . . is input to the D/A converter 101 to drive the video line V1+. The data stream of pixel data R1, G2, . . . is input to the D/A converter 102 to drive the video line V1−. The data stream of pixel data R2, G3, . . . is input to the D/A converter 101 to drive the video line V2+. Moreover, the data stream of pixel data B1, R3, . . . is input to the D/A converter 102 to drive the video line V2−. The D/A converter 101 converts each of pixel data G1, B2, . . . to an analog pixel signal of the positive polarity to be supplied to the video line V1+, and also converts each of pixel data R2, G3 . . . to an analog pixel signal of the positive polarity to be supplied to the video line V2+. On the other hand, the D/A converter 102 converts each of pixel data R1, G2, . . . to an analog pixel signal of the negative polarity to be supplied to the video line V1−, and also converts each of pixel data B1, R3 . . . to an analog pixel signal of the negative polarity to be supplied to the video line V2−.

According to the above modification, the video line Vin+ for transmitting the voltage of the analog pixel signal of the positive polarity and the video line Vin− for transmitting the voltage of the analog pixel signal of the negative polarity is separated from each other. As a result, electrical power consumed by the parasitic capacitances of the video lines Vin+ and Vin− can be reduced. Also, the video signal band width can be expanded. Moreover, the pixel signals of different colors such as R (Red), G (Green) can be transmitted through a common video line. Therefore, the number of the video lines can be decreased to reduce the circuitry size.

I claim:

1. A liquid crystal display comprising:

a matrix array of liquid crystal pixels;

a plurality of signal lines formed along columns of the liquid crystal pixels;

a plurality of driving transistors assigned to said liquid crystal pixels, for causing said signal lines to be electrically connected to the liquid crystal pixels of a selected row; and a signal line driver for driving said signal lines, wherein said signal line driver includes:

a signal distribution controller for causing digital pixel signals serially supplied for the liquid crystal pixels of the selected row to be output in parallel, a plurality of D/A converters arranged to correspond to said signal lines, for converting digital pixel signals output in parallel from said signal distribution controller into analog pixel signals, an amplifying section for amplifying the pixel signals obtained from the D/A converters, and a switch section for outputting the pixel signals obtained from the amplifying section to the signal lines;

said amplifying section includes groups of first and second amplifying circuits for amplifying the pixel signals obtained from adjacent two of said D/A converters in different polarities;

said first amplifying circuit is connected to a first power source to amplify the pixel signal in a positive polarity;

said second amplifying circuit is connected to a second power source to amplify the pixel signal in a negative polarity;

said switch section includes a plurality of switch circuits each for periodically exchanging adjacent two of said signal lines which receive the pixel signals obtained from said first and second amplifying circuits of a corresponding group;

each switch circuit includes a first switching element connected between said first amplifying circuit and one of said adjacent two signal lines, a second switching element connected between said first amplifying circuit and the other one of said adjacent two signal lines, a third switching element connected between said second amplifying circuit and the one of said adjacent two signal lines, and a fourth switching element connected between said second amplifying circuit and the other one of said adjacent two signal lines;

a pair of first and fourth switching elements and a pair of said second and third switching elements are controlled to alternately turn on in predetermined cycles by a control signal supplied externally;

said first and second switching elements are constituted by transistors of a first conductivity type; and said third and fourth switching elements are constituted by transistors of a second conductivity type.

2. A liquid crystal display according to claim 1, wherein said signal distribution controller includes signal order reversing means for reversing the order of every two serially-supplied digital pixel signals to cope with the exchange operations of said switch circuits.

3. A liquid crystal display according to claim 1, wherein components of said signal line driver are formed together with said driving transistors on an array substrate.

4. A liquid crystal display comprising:

a matrix array of liquid crystal pixels;

a plurality of signal lines formed along columns of the liquid crystal pixels;

a plurality of driving transistors assigned to said liquid crystal pixels, for causing said signal lines to be electrically connected to the liquid crystal pixels of a selected row; and a signal line driver for driving said signal lines, wherein said signal line driver includes:

a signal distribution controller for causing digital pixel signals serially supplied for the liquid crystal pixels of the selected row to be output in parallel, a plurality of D/A converters arranged to correspond to said signal lines, for converting digital pixel signals output in parallel from said signal distribution controller, into analog pixel signals, an amplifying section for amplifying the pixel signals obtained from the D/A converter; and a switch section for outputting the pixel signals obtained from the amplifying section to the signal lines;

said amplifying section includes groups of first and second amplifying circuits for amplifying the pixel signals obtained from adjacent two of said D/A converters in different polarities;

said first amplifying circuit is connected to a first power source to amplify the pixel signal in a positive polarity;

said second amplifying circuit is connected to a second power source to amplify the pixel signal in a negative polarity;

said switch section includes a plurality of switch circuits each for periodically exchanging adjacent two of said signal lines which receive the pixel signals obtained from said first and second amplifying circuits of a corresponding group; and said signal distribution controller includes a plurality of latch circuits arranged to correspond to said D/A converters, each for latching a corresponding one of the serially-supplied digital pixel signals, and a shift register circuit for sequentially enabling said latch circuits; and said shift register circuit includes latch order reversing means for reversing the latch order of every two latch circuits to cope with the operations of said switch circuits.

5. A liquid crystal display comprising:

a matrix array of liquid crystal pixels;

a plurality of signal lines formed along columns of the liquid crystal pixels;

a plurality of driving transistors assigned to said liquid crystal pixels, for causing said signal lines to be electrically connected to the liquid crystal pixel of a selected row; and a signal line driver for driving said signal lines, wherein said signal line driver includes:

a signal distribution controller for causing digital pixel signals serially supplied for the liquid crystal pixels of the selected row to be output in parallel, a plurality of D/A converters arranged to correspond to said signal lines, for converting digital pixel signals output in parallel from said signal distribution controller, into analog pixel signals, an amplifying section for amplifying the pixel signals obtained from the D/A converters, and a switch section for outputting the pixel signals obtained from the amplifying section to the signal lines;

said amplifying section includes groups of first and second amplifying circuits for amplifying the pixel signals obtained from adjacent two of said D/A converters in different polarities;

said first amplifying circuit is connected to a first power sources to amplify the pixel signal in a positive polarity;

said second amplifying circuit is connected to a second power source to amplify the pixel signal in a negative polarity;

said switch section includes a plurality of switch circuits each for periodically exchanging adjacent two of said signal lines which receive the pixel signals obtained from said first and second amplifying circuits of a corresponding group; and each switch circuit includes a canceling section for canceling a difference between the potentials of said adjacent two signal lines prior to outputting the pixel signals from said first and second amplifying circuits.

6. A liquid crystal display according to claim 5, wherein said canceling section includes a pair of switching elements each connected between a corresponding one of the adjacent two signal lines and a reference potential terminal set to an intermediate level for potential reversion.

7. A liquid crystal display according to claim 5, wherein said canceling section includes a switching element connected between said adjacent two signal lines.

8. A liquid crystal display comprising:

a matrix array of liquid crystal pixels;

a plurality of signal lines formed along columns of the liquid crystal pixels;

a plurality of driving transistors assigned to said liquid crystal pixels, for causing said signal lines to be electrically connected to the liquid crystal pixels of a selected row; and a signal line driver for driving said signal lines, wherein said signal line driver includes:

a first video bus for transmitting analog pixel signals of a positive polarity for the liquid crystal pixels of one of odd and even columns in a selected row, a second video bus for transmitting analog pixel signal of a negative polarity for the liquid crystal pixels of the other one of the odd and even columns in the selected row, a plurality of sample-hold units each assigned to corresponding adjacent two of said signal lines to simultaneously sample-hold the pixel signals transmitted through said first and second video buses, and a timing control circuit for sequentially enabling the operations of said sample-hold unit;

each sample-hold unit includes a first switch circuit for causing the first and second video buses to be respectively connected to one of the adjacent two signal lines and the other one of the adjacent two signal lines, and a second switch circuit for causing the first and second video buses to be respectively connected to the other one of the adjacent two signal lines and the one of the adjacent two signal lines;

said timing control circuit includes changing means for periodically switching between the first and second switch circuits of each sample-hold unit;

each sample-hold unit includes first and second switching elements serving as said first switch circuit, and third and fourth switching elements serving as said second switch circuit, said first switching element being connected between said first video bus and one of said adjacent two signal lines, said second switching element being connected between said second video bus and the other one of said adjacent two signal lines, said third switching element being connected between said first video bus and one of said adjacent two signal lines, and said fourth switching element being connected between said second video bus and the other one of said adjacent two signal lines;

said first and third switching elements are constituted by transistors of a first conductivity type, and said second and fourth switching elements are constituted by transistors of a second conductivity type.

9. A liquid crystal display according to claim 8, wherein said liquid crystal pixels are arranged in a predetermined color order, said first and second video buses transmit color pixel signals set to have an order corresponding to the color order of the liquid crystal pixels in a selected row as the analog pixel signals of a positive polarity and the analog pixel signals of a negative polarity.

10. A liquid crystal display according to claim 8, wherein said signal line driver further includes a first D/A converter for converting digital pixel signal into the analog pixel signals of a positive polarity to drive said first video bus, and a second D/A converter for converting the digital pixel signals into the analog pixel signals of a negative polarity to drive said second video bus.

11. A liquid crystal display according to claim 10, wherein said first and second D/A converters have the same structure except that the first and second D/A converters are connected to different power sources to obtain the analog pixel signals of the positive and negative polarities.

12. A liquid crystal display comprising:

a matrix array of liquid crystal pixels;

a plurality of signal lines formed along columns of the liquid crystal pixels;

a plurality of driving transistors assigned to said liquid crystal pixels, for causing said signal lines to be connected electrically to the liquid crystal pixels of a selected row; and a signal line driver for driving said signal lines, wherein said signal line driver includes:

a first video bus for transmitting analog pixel signals of a positive polarity for the liquid crystal pixels of one of odd and even columns in a selected row, a second video bus for transmitting analog pixel signals of a negative polarity for the liquid crystal pixels of the other one of the odd and even columns in the selected row, a plurality of sample-hold units each assigned to corresponding adjacent two of said signal lines to simultaneously sample-hold the pixel signal transmitted through said first and second video buses, and a timing control circuit for sequentially enabling the operations of said sample-hold units;

each sample-hold unit includes a first switch circuit for causing the first and second video buses to be respectively connected to one of the adjacent two signal lines and the other one of the adjacent two signal lines, and a second switch circuit for causing the first and second video buses to be respectively connected to the other one of the adjacent two signal lines and the one of the adjacent two signal lines;

said timing control circuit includes changing means for periodically switching between the first and second switch circuits of each sample-hold unit;

said signal line driver further include a first D/A converter for converting digital pixel signals into the analog pixel signals of a positive polarity to drive said first video bus, and a second D/A converter for converting the digital pixel signals into the analog pixel signals of a negative polarity to drive said second video bus;

said first and second D/A converters have the same structure except that the first and second D/A converters are connected to different power sources to obtain the analog pixel signals of the positive and negative polarities; and one of said first and second D/A converters is formed to receive the digital pixel signals through capacitive means.

13. A liquid crystal display comprising:

a matrix array of liquid crystal pixels;

a plurality of signal lines formed along columns of the liquid crystal pixels;

a plurality of driving transistors assigned to said liquid crystal pixels for causing said signal lines to be electrically connected to the liquid crystal pixels of a selected row; and a signal line driver for driving said signal lines, wherein said signal line driver includes:

a first video bus for transmitting analog pixel signals of a positive polarity for the liquid crystal pixels of one of odd and even columns in a selected row, a second video bus for transmitting analog pixel signals of a negative polarity for the liquid crystal pixels of the other one of the odd and even columns in the selected row, a plurality of sample-hold units each assigned to corresponding adjacent two of said signal lines to simultaneously sample-hold the pixel signals transmitted through said first and second video buses, and a timing control circuit for sequentially enabling the operations of said sample-hold units;

each sample-hold unit includes a first switch circuit for causing the first and second video buses to be respectively connected to one of the adjacent two signal lines and the other one of the adjacent two signal lines and a second switch circuit for causing the first and second video buses to be respectively connected to the other one of the adjacent two signal lines and the one of the adjacent two signal lines;

said timing control circuit includes changing means for periodically switching between the first and second switch circuits of each sample-hold unit;

said signal line driver further includes a first D/A converter for converting digital pixel signals into the analog pixel signals of a positive polarity to drive said first video bus, and a second D/A converter for converting the digital pixel signals into the analog pixel signals of a negative polarity to drive said second video bus; and said signal line driver includes first γ correcting means for correcting a γ characteristic of said first D/A converter and second γ correcting means for correcting a γ characteristic of said second D/A converter.

14. A liquid crystal display comprising:

a matrix array of liquid crystal pixels, a plurality of signal lines formed along columns of the liquid crystal pixels;

a plurality of driving transistors assigned to said liquid crystal pixels for causing said signal lines to electrically connected to the liquid crystal pixels of a selected row; and a signal line driver for driving said signal lines, wherein said signal line driver includes:

a first video bus for transmitting analog pixel signals of a positive polarity for the liquid crystal pixels of one of odd and even columns in a selected row, a second video bus for transmitting analog pixel signals of a negative polarity for the liquid crystal pixels of the other one of the odd and even columns in the selected row, a plurality of sample-hold units each assigned to corresponding adjacent two of said signal lines to simultaneously sample-hold the pixel signals transmitted through said first and second video buses, and a timing control circuit for sequentially enabling the operations of said sample-hold units;

each sample-hold unit includes a first switch circuit for causing the first and second video buses to be respectively connected to one of the adjacent two signal lines and the other one of the adjacent two signal lines, and a second switch circuit for causing the first and second video buses to be respectively connected to the other one of the adjacent two signal lines and the one of the adjacent two signal lines;

said timing control circuit includes changing means for periodically switching between the first and second switch circuits of each sample-hold unit; and said sample-hold unit includes a canceling section for canceling a difference between the potentials of said adjacent two signal lines prior to outputting of the pixel signals.

15. A liquid crystal display according to claim 14, wherein said canceling section includes a pair of switching elements each connected between a corresponding one of the adjacent two signal lines and a reference potential terminal set to an intermediate level for potential reversion.

16. A liquid crystal display according to claim 14, wherein said canceling section includes a switching element connected between said adjacent two signal lines.

17. A liquid crystal display comprising:

a matrix array of liquid crystal pixels;

a plurality of signal lines formed along columns of the liquid crystal pixels;

a plurality of driving transistors assigned to said liquid crystal pixels for causing said signal lines to be electrically connected to the liquid crystal pixels of a selected row; and a signal line driver for driving said signal lines, wherein said signal line driver includes:

a first video bus for transmitting analog pixel signals of a positive polarity for the liquid crystal pixels of one of odd and even columns in a selected row, a second video bus for transmitting analog pixel signals of a negative polarity for the liquid crystal pixels of the other one of the odd and even columns in the selected row, a plurality of sample-hold units each assigned to corresponding adjacent two of said signal lines to simultaneously sample-hold the pixel signals transmitted through said first and second video buses, and a timing control circuit for sequentially enabling the operations of said sample-hold units;

each sample-hold unit includes a first switch circuit for causing the first and second video buses to be respectively connected to one of the adjacent two signal lines and the other one of the adjacent two signal lines, and a second switch circuit for causing the first and second video buses to be respectively connected to the other one of the adjacent two signal lines and the one of the adjacent two signal lines;

said timing control circuit includes changing means for periodically switching between the first and second switch circuits of each sample-hold unit;

a preset number of bus groups each constituted by said first and second video buses are provided;

said sample-hold units are divided into blocks each constituted by the preset number of adjacent sample-hold units for sample-holding the pixel signals transmitted by the first and second video buses of different bus groups; and said timing control circuit is arranged to sequentially enable the operations of said blocks.

* * * * *